US011589165B2

(12) United States Patent
Jin et al.

(10) Patent No.: US 11,589,165 B2
(45) Date of Patent: Feb. 21, 2023

(54) SOUNDING DEVICE

(71) Applicant: AAC Microtech (Changzhou) Co., Ltd., Changzhou (CN)

(72) Inventors: Xin Jin, Shenzhen (CN); Zhiwei Zhong, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/536,108

(22) Filed: Nov. 29, 2021

(65) Prior Publication Data

US 2022/0174416 A1 Jun. 2, 2022

(30) Foreign Application Priority Data

Nov. 30, 2020 (CN) ..... 202022829829.6

(51) Int. Cl.
*H04R 9/02* (2006.01)
*H04R 7/18* (2006.01)

(52) U.S. Cl.
CPC ..... *H04R 9/025* (2013.01); *H04R 7/18* (2013.01); *H04R 2400/11* (2013.01)

(58) Field of Classification Search
CPC ..... H04R 9/025; H04R 7/18; H04R 2400/11; H04R 9/043; H04R 9/06; H04R 1/06
See application file for complete search history.

(56) References Cited

U.S. PATENT DOCUMENTS 9,813,821 B1 * 11/2017 Song ..... H04R 9/025
11,240,605 B2 * 2/2022 Song ..... H04R 9/025
2017/0366888 A1 * 12/2017 Xiao ..... H04R 9/06
2018/0027335 A1 * 1/2018 Li ..... H04R 7/18 381/398
2018/0027336 A1 * 1/2018 Li ..... H04R 9/025 381/398
2018/0302724 A1 * 10/2018 Li ..... H04R 1/06
2019/0238988 A1 * 8/2019 Xiao ..... H04R 9/025
2019/0238989 A1 * 8/2019 Xiao ..... H04R 9/025
2020/0213761 A1 * 7/2020 Xiao ..... H04R 7/04
(Continued)

FOREIGN PATENT DOCUMENTS

CN 110035362 A * 7/2019
CN 112449288 A * 3/2021 ..... H04R 9/025
CN 213073082 U * 4/2021
(Continued)

*Primary Examiner* — Angelica M McKinney
(74) *Attorney, Agent, or Firm* — W&G Law Group

(57) ABSTRACT

A sounding device includes a frame, a vibration system, and a magnetic circuit system having a magnetic gap. The vibration system includes a diaphragm fixed to the frame, a voice coil inserted in the magnetic gap to drive the diaphragm to vibrate, a framework connected to the diaphragm, and an elastic conductor fixed to the frame and connected to one side of the framework away from the diaphragm. One end of the voice coil has a lead wire. The framework and the voice coil define a receiving space. The elastic conductor includes an elastic conductor body fixed to the frame, first to third connectors, first and second bending arms. The first bending arm is spaced apart from the second bending arm. The lead wire is fixed to and electrically connected to the third connector. The sounding device has a good consistency in bending size and high pad position precision.

10 Claims, 6 Drawing Sheets

(56) References Cited

U.S. PATENT DOCUMENTS

2022/0174384 A1* 6/2022 Song ..... H04R 1/026

FOREIGN PATENT DOCUMENTS

| | | | | | |
|---|---|---|---|---|---|
| CN | 213126469 | U | * | 5/2021 | |
| CN | 214177561 | U | * | 9/2021 | |
| CN | 214315593 | U | * | 9/2021 | |
| CN | 214413036 | U | * | 10/2021 | |
| CN | 215647329 | U | * | 1/2022 | |
| CN | 112449288 | B | * | 3/2022 | ..... H04R 9/025 |
| CN | 216391402 | U | * | 4/2022 | |

* cited by examiner

A-A

SOUNDING DEVICE

TECHNICAL FIELD

The disclosure relates to the field of acoustoelectric, and in particular, to a sounding device.

BACKGROUND

With the advent of the Internet era, the number of mobile terminal devices continues to rise. Among mobile devices, mobile phones are undoubtedly the most common and portable mobile terminal devices. Sounding devices configured to play music and other sounds are widely used in the mobile terminal devices such as mobile phones. A vibration system in the sounding device is particularly important, and the whole sounding device vibrates and sounds through the vibration system.

In the related art, the sounding device includes a frame, a vibration system fixed to the frame, and a magnetic circuit system configured to drive the vibration system to vibrate to produce sound. The vibration system includes a diaphragm, a voice coil inserted in the magnetic gap to drive the diaphragm to vibrate, a framework connected to the diaphragm and suspending the voice coil below the diaphragm, and an elastic conductor connected to one side of the framework away from the diaphragm. The voice coil includes a lead wire electrically connected to the elastic conductor. The magnetic circuit system includes a yoke and a magnet fixed to the yoke. The magnet includes a main magnet and an auxiliary magnet forming a magnetic gap with the main magnet.

However, in the related art, the elastic conductor has poor consistency in bending size and low pad position precision.

Therefore, there is a need to provide a sounding device to solve the above problems.

SUMMARY

An objective of the disclosure is to provide a sounding device with good consistency in bending size and high pad position precision.

In order to achieve the above objective, the present disclosure provides a sounding device. The sounding device includes a frame, a vibration system fixed to the frame, and a magnetic circuit system configured to drives the vibration system to vibrate to produce sound. The magnetic circuit system has a magnetic gap. The vibration system includes a diaphragm fixed to the frame, a voice coil inserted in the magnetic gap to drive the diaphragm to vibrate, a framework connected to the diaphragm, and an elastic conductor fixed to the frame and connected to one side of the framework away from the diaphragm. One end of the voice coil is provided with a lead wire, and the framework and the voice coil define a receiving space. The elastic conductor includes an elastic conductor body fixed to the frame, a first connector, a second connector, a third connector, a first bending arm, and a second bending arm. The first connector extends from the elastic conductor body toward the second connector, and the second connector extends from the elastic conductor body toward the first connector. The first bending arm is bent and extends from the first connector toward an interior of the receiving space along the framework. The second bending arm is bent and extends from the second connector toward the interior of the receiving space along the framework. The third connector connects the first bending arm with the second bending arm. The first bending arm is spaced apart from the second bending arm, and the lead wire is fixed to and electrically connected to the third connector.

As an improvement, the first connector includes a first elastic portion extending from the elastic conductor body and a first connection portion bending and extending from the first elastic portion towards the second connector. The second connector includes a second elastic portion extending from the elastic conductor body, and a second connection portion bending and extending from the second elastic portion towards the first connector. The first connector is spaced apart from the second connector, and both the first connection portion and the second connection portion are connected to one end of the framework away from the diaphragm.

As an improvement, the framework includes a bottom wall fixed to the diaphragm and a sidewall bending and extending from the bottom wall towards the magnetic circuit system, and one end of the sidewall away from the diaphragm is fixedly connected to the first connector and the second connector.

As an improvement, the bottom wall is ring-shaped, and the sidewall includes at least one first sidewall bending and extending from an outer periphery of the bottom wall towards the magnetic circuit system, and a second sidewall bending and extending from an inner periphery of the bottom wall towards the magnetic circuit system. One of the at least one first sidewall is connected to the first connector and the second connector. The second sidewall is connected to the voice coil. Each of the at least one first sidewall is spaced apart from and opposite to the voice coil. The bottom wall, the at least one first sidewall, the second sidewall, and the voice coil define the receiving space.

As an improvement, the third connector is fixedly connected to one side of the bottom wall away from the diaphragm.

As an improvement, the voice coil is in a racetrack shape and includes a pair of minor-axis sides and a pair of major-axis sides, the at least one first sidewall includes two first sidewalls that are spaced apart from each other and that are respectively located on the pair of minor-axis sides of the voice coil, and the second sidewall is ring-shaped and connected to one end of the voice coil close to the diaphragm.

As an improvement, the first bending arm includes a first bending portion close to one of the two first sidewalls and a second bending portion bending and extending from the first bending portion towards the second sidewall. The second bending portion is fixed to one side of the bottom wall away from the diaphragm. The second bending arm includes a third bending portion close to one of the two first sidewalls and a fourth bending portion bending and extending from the third bending portion towards the second sidewall. The fourth bending portion is fixed to one side of the bottom wall away from the diaphragm As an improvement, the magnetic circuit system includes a yoke, a main magnet arranged on the yoke, and a first auxiliary magnet and a second auxiliary magnet that surround the main magnet. The first auxiliary magnet is located on one of the pair of the minor-axis side of the voice coil and comprises a magnet body and an extension portion extending from the magnet body. Each of the two first sidewalls is provided with a first avoiding opening, and the extension portion extends from the first avoiding opening and is located between the first connector and the second connector As an improvement, the vibration system further includes an auxiliary diaphragm attached to one side of the elastic conductor away from the diaphragm.

As an improvement, the auxiliary diaphragm is provided with a second avoiding opening, and the first avoiding opening is communicated with the second avoiding opening to accommodate the extension portion.

Compared with the related art, in the sounding device according to the disclosure, the elastic conductor includes the elastic conductor body fixed to the frame, the first connector, the second connector, the third connector, the first bending arm, and the second bending arm. The first connector extends from the elastic conductor body toward the second connector, and the second connector extends from the elastic conductor body toward the first connector. The first bending arm is bent and extends from the first connector toward the interior of the receiving space along the framework. The second bending arm is bent and extends from the second connector toward the interior of the receiving space along the framework, and the third connector connects the first bending arm with the second bending arm. The lead wire is fixed to and electrically connected to the third connector. The first bending arm is spaced apart from the second bending arm. In this way, consistency in bending size and the pad position precision are improved. The first bending arm is spaced apart from the second bending arm, so that the extension portion of the first auxiliary magnet can extend to a position located between the first connector and the second connector through an interval between the first bending arm and the second bending arm, which increases an area of the first auxiliary magnet, thereby improving acoustic performance of the sounding device.

BRIEF DESCRIPTION OF DRAWINGS

In order to more clearly illustrate the technical solutions in embodiments of the disclosure, the accompanying drawings used in the description of the embodiments will be briefly introduced below. The accompanying drawings in the following description illustrate only some embodiments of the disclosure, and other drawings can be obtained by those of ordinary skill in the art from the provided drawings.

DESCRIPTION OF EMBODIMENTS

The technical solutions in the embodiments of the disclosure will be described clearly and completely below with reference to the accompanying drawings in the embodiments of the disclosure. Apparently, the described embodiments are merely some of rather than all of the embodiments of the disclosure. All other embodiments acquired by those skilled in the art based on the embodiments of the disclosure shall fall within the protection scope of the disclosure.

Figure 1:
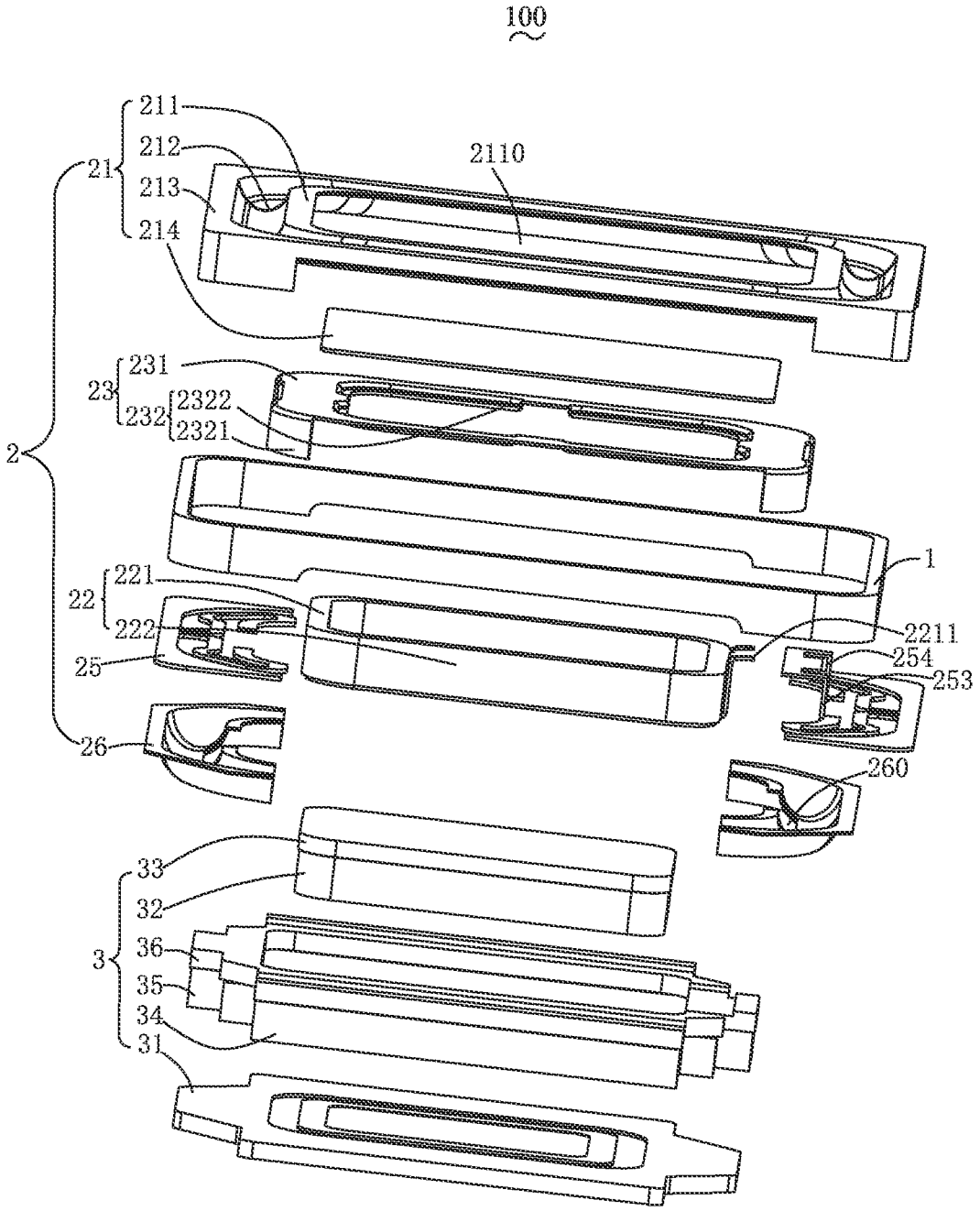
FIG. 1 is a schematic exploded view of a three-dimensional structure of a sounding device according to the disclosure.
Figure 2:
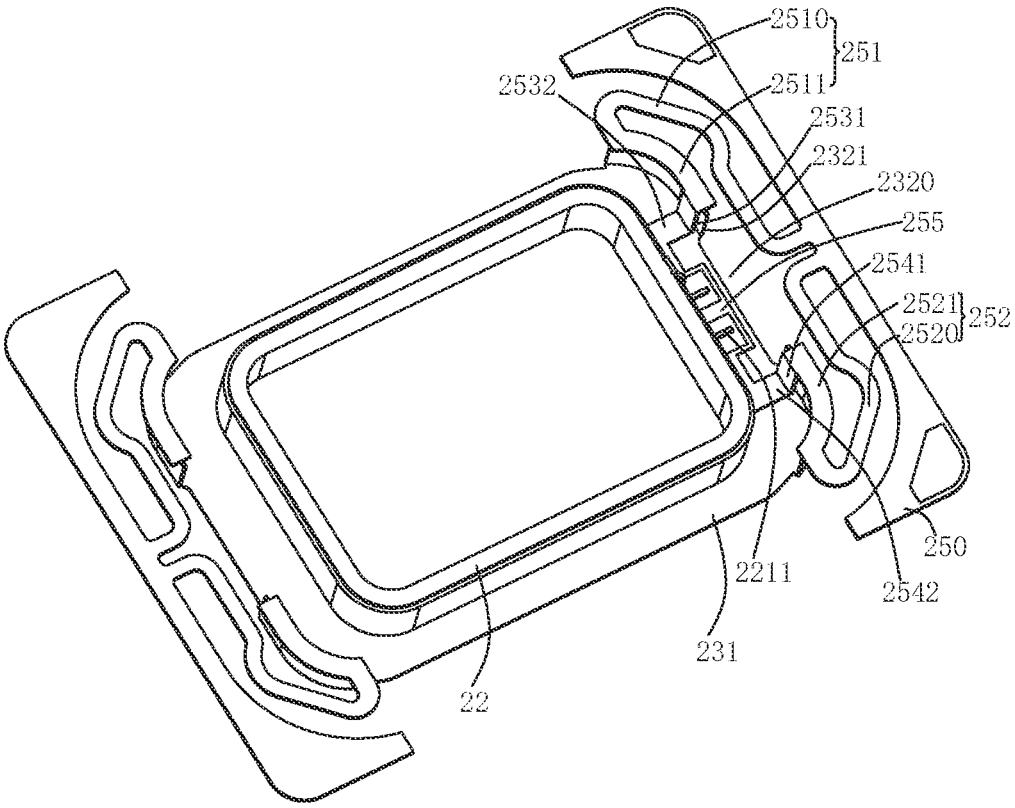
FIG. 2 is a schematic diagram of a three-dimensional structure of a combination of a voice coil, a framework and an elastic conductor of the sounding device according to the disclosure.
Figure 3:
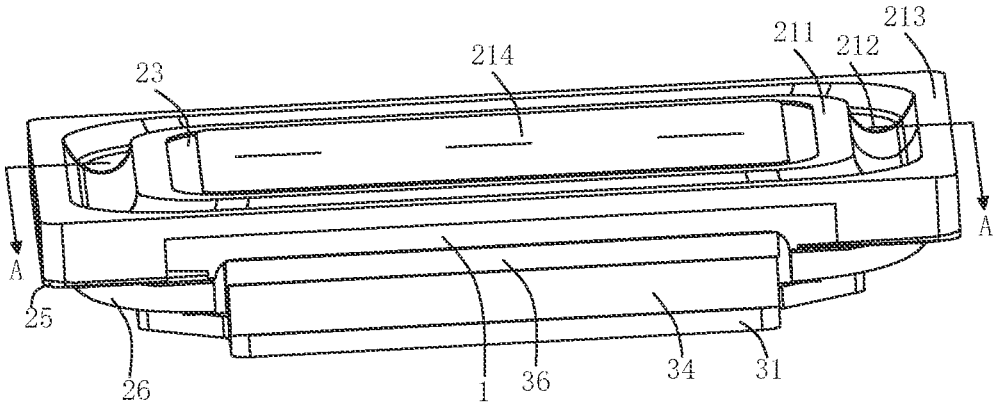
FIG. 3 is a schematic diagram of a three-dimensional structure of the sounding device according to the disclosure.
Figure 4:
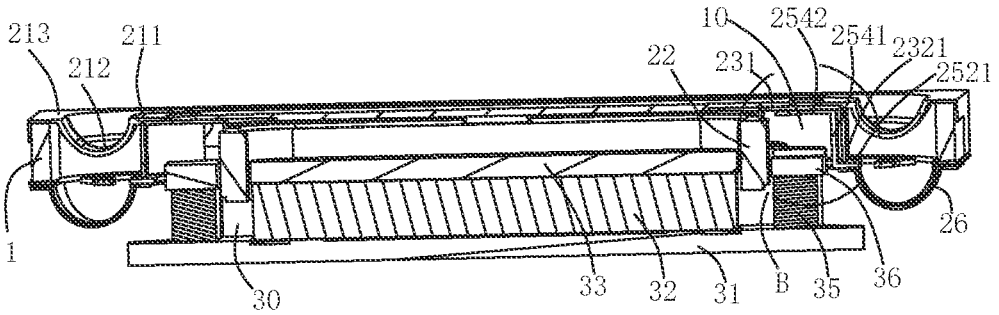
FIG. 4 is a sectional view of the sounding device according to the disclosure taken along a line A-A in FIG. 3.
Figure 5:
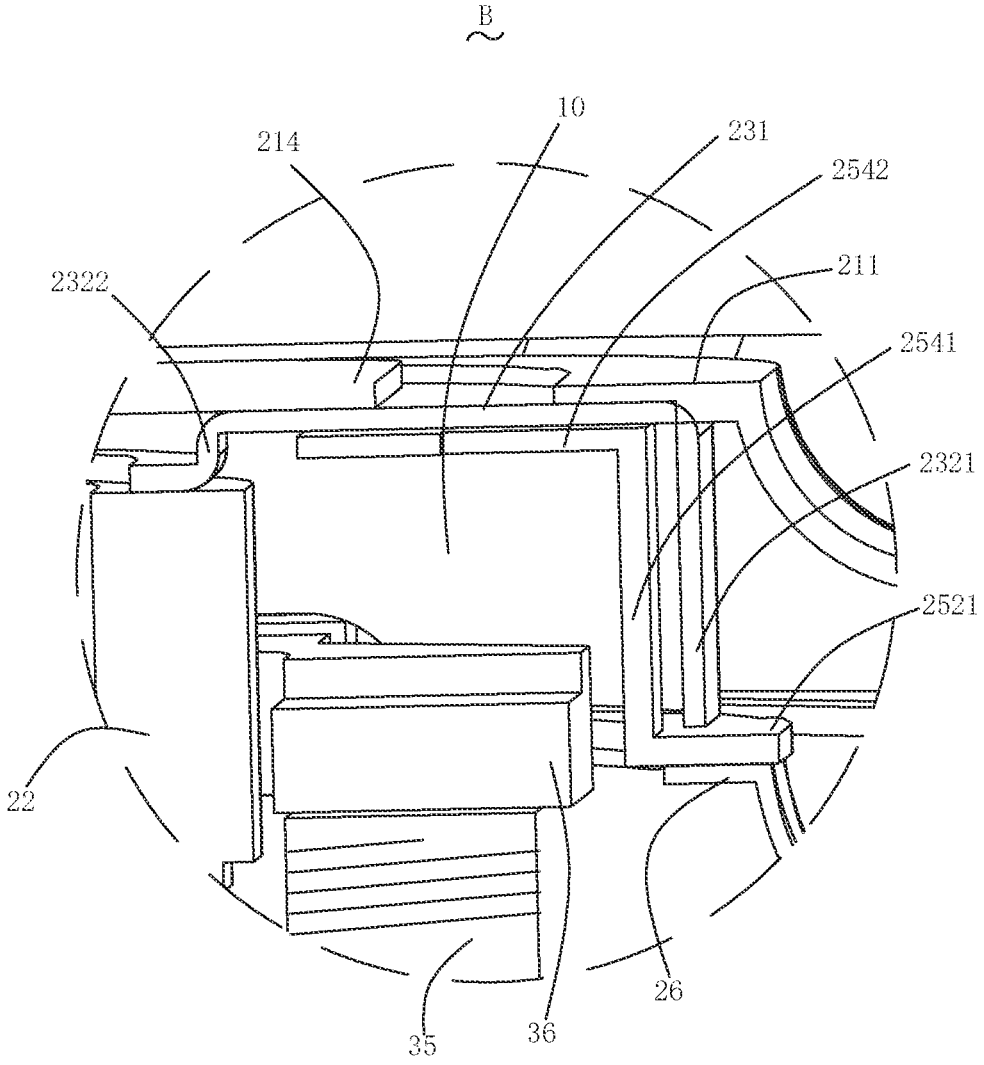
FIG. 5 is an enlarged schematic diagram of B of the sounding device according to the disclosure in FIG. 4.
Figure 6:
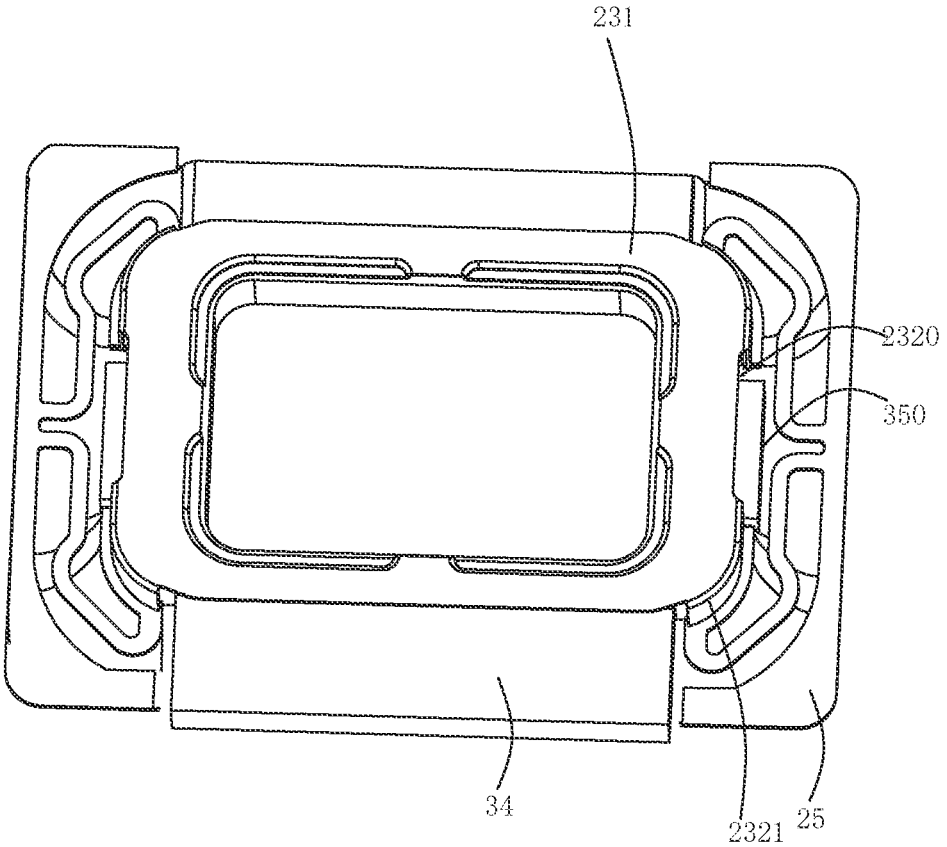
FIG. 6 is a schematic diagram of a partial combined structure of the sounding device according to the disclosure.

Referring to FIG. 1 to FIG. 6, the disclosure provides a sounding device 100. The sounding device 100 includes a frame 1, a vibration system 2 fixed to the frame 1, and a magnetic circuit system 3 configured to drive the vibration system 2 to vibrate to produce sound. The magnetic circuit system 3 has a magnetic gap 30.

The vibration system 2 includes a diaphragm 21 fixed to the frame 1, a voice coil 22 inserted in the magnetic gap 30 to drive the diaphragm 21 to vibrate, a framework 23 connected to the diaphragm 21, an elastic conductor 25 fixed to the frame 1 and connected to one side of the framework 23 away from the diaphragm 21, and an auxiliary diaphragm 26. The framework 23 and the voice coil 22 define a receiving space 10.

The diaphragm 21 includes a vibration portion 211 having a through hole 2110, a suspension portion 212 extending from a periphery of the vibration portion 211 and surrounding the vibration portion 211, a fixed portion 213 bending and extending from the suspension portion 212 towards one side of the suspension portion 212 away from the vibration portion 211 and fixed to the frame 1, and a dome 214. The vibration portion 211 surrounds and is spaced apart from the dome 214.

The voice coil 22 is in a racetrack shape and has one end away from the diaphragm 21 inserted in the magnetic gap 30. The voice coil 22 includes a pair of minor-axis sides 221 that are spaced apart from each other, and a pair of major-axis side 222 that are spaced apart from each other. The minor-axis side 221 is provided with two lead wires 2211.

The framework 23 includes a bottom wall 231 fixed to the vibration portion 211 and in a ring-shape, and a sidewall 232 bending and extending from the bottom wall 231 towards the magnetic circuit system 3.

In an embodiment, the sidewall 232 includes a first sidewall 2321 bending and extending from an outer periphery of the bottom wall 231 towards the magnetic circuit system 3, and a second sidewall 2322 bending and extending from an inner periphery of the bottom wall 231 towards the magnetic circuit system 3. Two first sidewalls 2321 are provided and spaced apart from each other and are respectively located at two opposite sides of a minor axis of the voice coil 22, and the second sidewall 2322 is ring-shaped and is connected to one end of the voice coil 22 close to the diaphragm 21.

The first sidewall 2321 is spaced apart from and opposite to the voice coil 22. The bottom wall 231, the first sidewall 2321, the second sidewall 2322, and the voice coil 22 define the receiving space 10 together. The first sidewall 2321 is provided with a first avoiding opening 2320 formed by ablation of the first sidewall 2321.

In an embodiment, the bottom wall 231 is located between the dome 214 and the vibration portion 211 and connect the vibration portion 211 with the dome 214 into one piece, which has better reliability.

Two elastic conductors 25 are provided and are respectively arranged on the two minor-axis sides 221 of the voice coil 22. The elastic conductor 25 includes an elastic conductor body 250 fixed to the frame 1, a first connector 251, a second connector 252, a third connector 255, a first bending arm 253, and a second bending arm 254. The first connector 251 extends from the elastic conductor body 250 toward the second connector 252, and the second connector 252 extends from the elastic conductor body 250 toward the first connector 251. The first bending arm 253 is bent and extends from the first connector 251 toward an interior of the receiving space 10 along the framework 23, and the second bending arm 254 is bent and extends from the second connector 252 toward an interior of the receiving space 10 along the framework. The third connector 255 connects the first bending arm 253 with the second bending arm 254. The first connector 251 is spaced apart from the second connector 252. The first bending arm 253 is spaced apart from the second bending arm 254. The first connector 251 includes a first elastic portion 2510 extending from the elastic conductor body 250 and a first connection portion 2511 bending and extending from the first elastic portion 2510 towards the second connector 252. The second connector 252 includes a second elastic portion 2520 extending from the elastic conductor body 250 and a second connection portion 2521 bending and extending from the second elastic portion 2520 towards the first connector 251. The first elastic portion 2510 is spaced apart from the second elastic portion 2520. The first connection portion 2511 and the second connection portion 2521 extend toward each other and are spaced. Both the first connection portion 2511 and the second connection portion 2521 are connected to one end of the framework 23 away from the diaphragm. In this embodiment, it may be understood that, since the lead wire is led out from only one side of the voice coil, the other elastic conductor 25 can be provided with no bending arm and provided with no third connector.

In an embodiment, the first bending arm 253 includes a first bending portion 2531 bending and extending from the first connector 251 towards the bottom wall 231 along the first sidewall 2321 and located in the receiving space 10, and a second bending portion 2532 bending and extending from the first bending portion 2531 towards the second sidewall 2322. The second bending arm 254 includes a third bending portion 2541 bending and extending from the second connector 252 towards the bottom wall 231 along the first sidewall 2321 and located in the receiving space 10, and a fourth bending portion 2542 bending and extending from the third bending portion 2541 towards the second sidewall 2322. The third connector 255 is connected to the second bending portion 2532 and the fourth bending portion 2542. The two lead wires 2211 of the voice coil 22 are connected to the third connector 255 by welding. Both the first bending portion 2531 and the third bending portion 2541 are spaced apart from and parallel to the first sidewall 2321. The second bending portion 2532, the fourth bending portion 2542, and the third connector 255 are attached to one side of the bottom wall 231 close to the voice coil 22.

The elastic conductor body 250 is fixed to one side of the frame 1 away from the diaphragm 21. The first connector 251 and the second connector 252 are spaced apart from each other and are fixed to one side of the first sidewall 2321 away from the diaphragm 21.

The auxiliary diaphragm 26 is attached to one side of the elastic conductor 25 away from the diaphragm 21. The auxiliary diaphragm is provided with a second avoiding opening 260. The second avoiding notch 260 is communicated with the first avoiding notch 2320.

The magnetic circuit system 3 includes a yoke 31, a main magnet 32, a main magnetic conduction plate 33, two second auxiliary magnets 34, two first auxiliary magnets 35, and an auxiliary magnetic conduction plate 36. The main magnet 32 is mounted to one side of the yoke 31 close to the frame 1. The main magnetic conduction plate 33 is mounted to one side of the main magnet 32 close to the frame 1. The second auxiliary magnet 34 and the first auxiliary magnet 35 are mounted to one side of the yoke 31 close to the frame 1 and each are spaced apart from the main magnet 32. The auxiliary magnetic conduction plate 36 is mounted to one side of the second auxiliary magnet 34 and the first auxiliary magnet 35 close to the frame 1 and is spaced apart from the main magnetic conduction plate 33. One side of the auxiliary magnetic conduction plate 36 away from the yoke 31 is fixed to the frame 1. Specifically, the main magnet 32 is roughly a cuboid, which has a minor axis and a major axis. The two second auxiliary magnets 34 correspond to the major axis of the main magnet 32. The two first auxiliary magnets 35 correspond to the minor axis of the main magnet 32. The second auxiliary magnet 34 and the first auxiliary magnet 35 are spaced apart from the main magnet 32 to form the magnetic gap 30. One end of the voice coil 22 away from the diaphragm 21 is inserted in the magnetic gap 30. The two first auxiliary magnets 35 each are a cuboid. The first auxiliary magnet 35 includes a magnet body 351 and an extension portion 350 extending away from the main magnet 32. The extension portion 350 extends from the first avoiding notch 2320, is located between the first connector 251 and the second connector 252, and is received in the second avoiding notch 260. The design of the extension portion 350 increases a volume of the first auxiliary magnet 35, thereby improving the acoustic performance of the sounding device 100.

Compared with the related art, in the sounding device according to the disclosure, the elastic conductor includes the elastic conductor body fixed to the frame, the first connector, the second connector, the third connector, the first bending arm, and the second bending arm. The first connector extends from the elastic conductor body toward the second connector, and the second connector extends from the elastic conductor body toward the first connector. The first bending arm is bent and extends from the first connector toward the interior of the receiving space along the framework. The second bending arm is bent and extends from the second connector toward the interior of the receiving space along the framework, and the third connector connects the first bending arm with the second bending arm. The lead wire is fixed to and electrically connected to the third connector. The first bending arm is spaced apart from the second bending arm. In this way, consistency in bending size and the pad position precision are improved. The first bending arm is spaced apart from the second bending arm, so that the extension portion of the first auxiliary magnet can extend to a position located between the first connector and the second connector through an interval between the first bending arm and the second bending arm, which increases an area of the first auxiliary magnet, thereby improving acoustic performance of the sounding device.

The above illustrates only implementations of the disclosure and not thus intended to limit the patent scope of the disclosure. All equivalent structures or equivalent flow transformations made by virtue of contents of the specification and the drawings of the disclosure or direct or indirect application of the contents to the other related technical fields shall fall within the protection scope of the disclosure.

What is claimed is:

1. A sounding device, comprising:

a frame;

a vibration system fixed to the frame; and a magnetic circuit system configured to drive the vibration system to vibrate to produce sound, wherein the magnetic circuit system has a magnetic gap; the vibration system comprises a diaphragm fixed to the frame, a voice coil inserted in the magnetic gap to drive the diaphragm to vibrate, a framework connected to the diaphragm, and an elastic conductor fixed to the frame and connected to one side of the framework away from the diaphragm, wherein one end of the voice coil is provided with a lead wire, and the framework and the voice coil define a receiving space;

the elastic conductor comprises an elastic conductor body fixed to the frame, a first connector, a second connector, a third connector, a first bending arm, and a second bending arm, wherein the first connector extends from the elastic conductor body toward the second connector, and the second connector extends from the elastic conductor body toward the first connector; the first bending arm is bent and extends from the first connector toward an interior of the receiving space along the framework; the second bending arm is bent and extends from the second connector toward the interior of the receiving space along the framework; the third connector connects the first bending arm with the second bending arm; and the first bending arm is spaced apart from the second bending arm, and the lead wire is fixed to and electrically connected to the third connector.

2. The sounding device as described in claim 1, wherein the first connector comprises a first elastic portion extending from the elastic conductor body, and a first connection portion bending and extending from the first elastic portion towards the second connector; and the second connector comprises a second elastic portion extending from the elastic conductor body, and a second connection portion bending and extending from the second elastic portion towards the first connector; and the first connector is spaced apart from the second connector, and both the first connection portion and the second connection portion are connected to one end of the framework away from the diaphragm.

3. The sounding device as described in claim 1, wherein the framework comprises a bottom wall fixed to the diaphragm, and a sidewall bending and extending from the bottom wall towards the magnetic circuit system, wherein one end of the sidewall away from the diaphragm is fixedly connected to the first connector and the second connector.

4. The sounding device as described in claim 3, wherein the bottom wall is ring-shaped, and the sidewall comprises at least one first sidewall bending and extending from an outer periphery of the bottom wall towards the magnetic circuit system, and a second sidewall bending and extending from an inner periphery of the bottom wall towards the magnetic circuit system, wherein one of the at least one first sidewall is connected to the first connector and the second connector; the second sidewall is connected to the voice coil; each of the at least one first sidewall is spaced apart from and opposite to the voice coil; and the bottom wall, the at least one first sidewall, the second sidewall, and the voice coil define the receiving space.

5. The sounding device as described in claim 4, wherein the third connector is fixedly connected to one side of the bottom wall away from the diaphragm.

6. The sounding device as described in claim 5, wherein the voice coil is in a racetrack shape and comprises a pair of minor-axis sides and a pair of major-axis sides, the at least one first sidewall comprises two first sidewalls that are spaced apart from each other and that are respectively located on the pair of minor-axis sides of the voice coil, and the second sidewall is ring-shaped and connected to one end of the voice coil close to the diaphragm.

7. The sounding device as described in claim 6, wherein the first bending arm comprises a first bending portion close to one of the two first sidewalls, and a second bending portion bending and extending from the first bending portion towards the second sidewall, wherein the second bending portion is fixed to the one side of the bottom wall away from the diaphragm; and the second bending arm comprises a third bending portion close to the other of the two first sidewalls, and a fourth bending portion bending and extending from the third bending portion towards the second sidewall, wherein the fourth bending portion is fixed to the one side of the bottom wall away from the diaphragm.

8. The sounding device as described in claim 7, wherein the magnetic circuit system comprises a yoke, a main magnet arranged on the yoke, and a first auxiliary magnet and a second auxiliary magnet that surround the main magnet, wherein the first auxiliary magnet is located on one of the pair of the minor-axis side of the voice coil and comprises a magnet body and an extension portion extending from the magnet body; and each of the two first sidewalls is provided with a first avoiding opening, and the extension portion extends from the first avoiding opening and is located between the first connector and the second connector.

9. The sounding device as described in claim 8, wherein the vibration system further comprises an auxiliary diaphragm attached to one side of the elastic conductor away from the diaphragm.

10. The sounding device as described in claim 9, wherein the auxiliary diaphragm is provided with a second avoiding opening, and the first avoiding opening is communicated with the second avoiding opening to accommodate the extension portion.

* * * * *